United States Patent [19]

Ritzerfeld

[11] 4,002,117

[45] Jan. 11, 1977

[54] ROTARY COPYING MACHINE

[76] Inventor: Gerhard Ritzerfeld, Schorlemer Allee 14, 1000 Berlin 33, Germany

[22] Filed: Aug. 1, 1975

[21] Appl. No.: 601,165

[30] Foreign Application Priority Data

Aug. 2, 1974 Germany ..... 2437817

[52] U.S. Cl. ..... 101/91; 101/132.5

[51] Int. Cl.[2] ..... B41L 47/46

[58] Field of Search ..... 101/91, 53, 132.5, 141, 101/147, 366; 92/13.1, 13.2, 13, 13.3, 13.4, 13.5, 13.51, 13.6, 13.7

[56] References Cited

UNITED STATES PATENTS

| | | | |
|---|---|---|---|
| 2,745,340 | 5/1956 | Ritzerfeld et al. | 101/132.5 |
| 2,761,391 | 9/1956 | Johnston | 92/13.7 X |
| 2,872,896 | 2/1959 | Brown | 101/132.5 X |
| 3,077,829 | 2/1963 | Ritzerfeld et al. | 101/91 |
| 3,238,868 | 3/1966 | Ritzerfeld et al. | 101/91 |
| 3,299,827 | 1/1967 | Ferrari et al. | 92/13.6 X |
| 3,776,133 | 12/1973 | Ritzerfeld | 101/132.5 X |
| 3,902,410 | 9/1975 | Shepherd | 101/53 |

*Primary Examiner*—Edward M. Coven
*Attorney, Agent, or Firm*—Michael J. Striker

[57] ABSTRACT

A rotary copying machine adjustable for a full page printing respectively line printing of sheets from a printing form on a rotatable printing drum has a device for moistening the sheets to be printed, and wherein the stroke of a piston pump for supplying liquid to the moistening device is automatically adjusted depending on whether the copying machine is adjusted for printing of a full page or for printing a section, i.e., one or a plurality of lines of a page.

7 Claims, 3 Drawing Figures

ROTARY COPYING MACHINE

BACKGROUND OF THE INVENTION

The present invention relates to a rotary copying machine for printing a full page or for printing a line or a section of a printing form on a rotatable printing drum with a device for moistening the sheets to be printed, wherein the moistening liquid is fed to the moistening device by means of a pump with an adjustable stroke.

As a rule, sheets of different size are used in rotary copying machines depending on whether the copying machine is used for printing a full page or for printing a line or a section of a printing form on the rotatable printing drum of the machine. If printing of a full page is desired, the sheets used are usually twice the size as the sheets used for printing a line or a section of a full page. The feeding of the liquid to the means for moistening the sheet, preferably a moistening felt, has therefore to be regulated in such a manner that at each or a predetermined number of revolutions of the printing drum of the rotary copying machine a predetermined amount of liquid is pumped to the moistening felt. The necessary amount of liquid will depend on the size of the sheet to be printed so that this amount has to be changed during adjustment of the copying machine for printing a full page, a line or a section of a full page. This is accomplished according to the prior art by the operator who adjusts by means of an eccentric the piston stroke of the pump feeding the liquid. However, in this known manner of adjustment it happens often that, due to faulty operation, an adjustment of the liquid to be fed according to the size of the sheets used will either not be carried out at all or be carried out in insufficient manner so that the sheets will either be moistened too much or too little, whereby the quality of the printing will be detrimentally affected.

SUMMARY OF THE INVENTION

It is an object of the present invention to provide a rotary copying machine in which an automatic adjustment of the liquid for moistening the sheets to be printed will be carried out depending on whether the rotary copying machine is adjusted for printing a full page, a line, or a section of a full page.

With this and other objects in view, which will become apparent as the description proceeds, the rotary copying machine according to the present invention mainly comprises a rotatable printing drum carrying a printing form, a counter pressure roller movable toward and away from the printing drum, means for feeding sheets to be printed between the printing drum and the counter pressure roller, adjustable means for cyclically moving the counter pressure roller during each revolution of said printing drum for full page printing or line printing of the printing form on the respective sheet, means for feeding a moistening liquid onto the sheet during feeding thereof between the drum and the roller and comprising a pump with a reciprocating piston, adjustable stop means, and locating means operatively connected to said adjustable means for locating said adjustable stop means in the path of the piston to limit the stroke of the latter during line printing. The stop means preferably comprises a first stop movable in a direction transverse to the direction of movement of the piston between two end positions and steplessly adjustable in the direction of movement of the piston. The stop means may further comprise a second stop steplessly adjustable in the direction of movement of the piston for adjusting the stroke of the latter during full page printing. The first and the second stop may be connected to each other for movement together in the direction of movement of the piston and the locating means preferably comprises biasing means to locate the first stop in the path of the piston during line printing and an electromagnet energizable to withdraw the first stop out of the path during full page printing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 3:
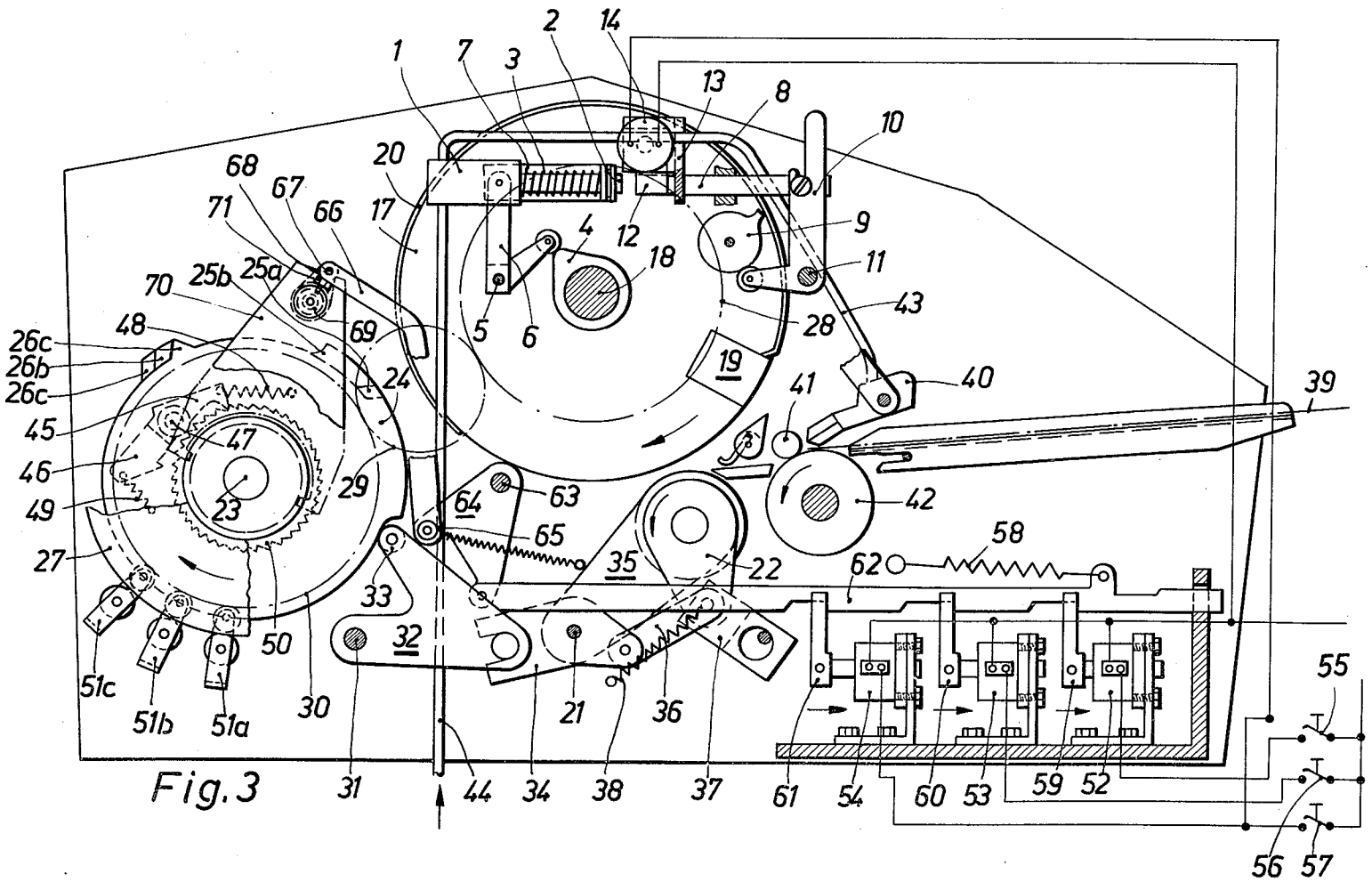
FIG. 3 schematically illustrates, in a side view, the overall arrangement of the rotary coying machine with the arrangement shown in FIGS. 1 and 2 for adjusting the stroke of the pump.

Referring first to FIG. 3, it will be seen that the rotary copying machine according to the present invention comprises a printing drum 17, which together with a cam disk 4 is mounted on a shaft 18 for rotation therewith. The shaft 18 is driven in the direction indicated by the arrow by means of a chain or a belt drive, not shown in the drawing, from a motor of the machine, likewise not shown. A printing form 20 is held on the peripheral surface of the printing drum 17 by means of a schematically shown clamping device 19. A back pressure roller 22 is tiltable about the axis of a fixed shaft 21 toward and away from the printing drum 17. The control of movement of the back pressure roller 22 toward and away from the printing drum 17 during each revolution of the latter for printing a full page, a line, or a section of the printing form 20 is carried out by means of a plurality of cams which are axially moveable on a shaft 23. The cams on the shaft 23 may comprise a head cam 24, continuation cams **25*a* and 25*b* of different active lengths, line cams 26*a*, 26*b* and 26*c*, as well as an elongated cam 27. The line cams 26*a*–26*c* are adjustable in radial and axial direction and have different active lengths. The cams 26*a*–26*c* serve for printing, for instance one, two, three, or more lines of the printing form 20. The elongated cam 27 serves for full page printing of the printing form 20.**

In order to assure a synchronous movement of the cams on the shaft 23 together with the printing drum 17, the drive of the shaft 23 is produced by a gear 28 fixed to the shaft 18, a gear 30 fixed to the shaft 23 and an intermediate gear 29 as schematically shown in FIG. 3. A plurality of roller followers 33 respectively mounted on levers 32 tiltable about a fixed shaft 31 respectively cooperate with the aforementioned cams, on which these cams act depending on the radial, respectively axial adjustment thereof. Due to the different acting lengths of the individual cams a corresponding adjustment of the position of the levers 32 is obtained. The movement of the levers 32 is transmitted to the backpressure roller 22 by means of linkage means 34–37 shown in FIG. 3 so that the roller 22 is cyclically moved toward and away from the printing form 20 on the periphery of the printing drum, whereby movement of the roller 22 away from the periphery of the printing drum 17 is performed by a spring 38.

The feeding of the sheets 39 to be printed to the printing line between the printing drum 17 and the backpressure roller 22 is carried out, in a known manner beneath a moistening device 40, which includes the abovementioned moistening felt, contactng the upper faces of the sheets, fed by means of cooperating transport rollers 41 and 42. The moistening device 40 is supplied through a conduit 43 by means of a piston pump 1, which pumps such fluid from a further conduit 44 from a non-illustrated liquid container. The piston 2 of the piston pump 1 is moved along the pumping stroke by means of an angle lever 6 tiltable about a fixed axis 5. The angle lever 6 is pivotably connected at one of the ends thereof by a member 7 to the outer end of the piston 2, and the other end of the angle lever 6 carries a follower roller engaging the cam 4 fixed to the shaft 18 of the printing drum, whereas movement of the piston in the opposite direction is carried out by a coil spring 3 which assures also permanent contact of the roller follower on the angle lever 6 with the contour of the cam 4.

The adjustment of the line cams 26*a*–26*c* in circumferential direction is carried in a known manner by a control mechanism including a locking pawl 45, a transporting pawl 46, both turnably arranged on a bolt 47 and respectively held by springs 48 and 49 in engagement with the ratchet wheel 50. The control mechanism moves together with the aforementioned cams about the shaft 23. A non-illustrated spiral spring arranged about the shaft 23 acts on the ratchet wheel 50 and tends to move the ratchet wheel 50 and the line cams connected thereto in clockwise direction, but such movement is prevented by the locking pawl 45. Control rollers 51*a*, 51*b* and 51*c* are selectively moveable into the paths of the control arrangement to act respectively onto the transport pawl 46 and the locking pawl 45 so that during each revolution of the cams, respectively the control arrangement about the shaft 23, the line cams are moved in circumferential direction for one, two, three or a plurality of lines in a direction opposite to the direction of turning movement of the shaft 23.

The axial movement of the control cams on the shaft 23 is carried out by pull magnets, as more specifically described in the U.S. Pat. No. 3,238,868, of which only the pull magnets 52, 53 and 54 are shown in FIG. 3 which serve for axial movement of the continuation cams 25*a* and 25*b* and the elongated cam 27. For the line cams 26*a*–26*c* are three corresponding pull magnets necessary, which are not illustrated in FIG. 3. The head cam 24 is non-axially moveable fixed to the shaft 23. The pull magnets have, respectively, different strokes corresponding to the necessary axial movement of the various control cams. To move the continuation cams 25*a* and 25*b* into cooperative engagement with one of the follower rollers 33, the pull magnets 52 and 53 are energized by closing the switches 55 and 56 so that the armatures of the magnet are attracted in opposition to the action of a tension spring 58 and so that the control rod 62 connected with the armatures by the levers 59 and 56 is correspondingly shifted. Shifting of the control rod 62 against the action of the spring 58 is transmitted in a known manner by means of a triangular lever 64 tiltable about a fixed bolt 63, the lever 66 pivotably connected at one end by a bolt 65 to the triangular lever 64 and at the other end by a bolt 67 to lever arm on a sleeve 68 mounted turnably but axially immovably on a stationary shaft. Sleeve 68 has a spiral groove 69 into which a pin 71 on the nut of a switch fork 70 engages axially to thereby shift the fork 70 and correspondingly move the continuation cams 25*a* and 25*b* into the region of a follower roller 33.

Figure 1:
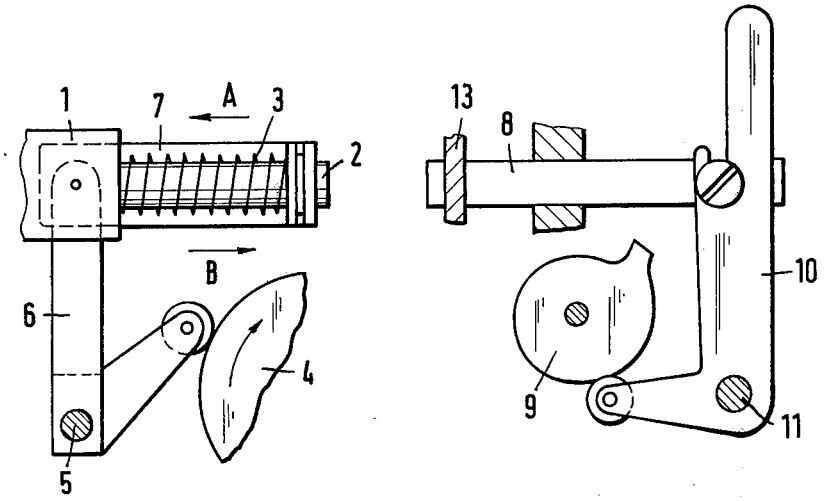
FIG. 1 partially illustrates in a side view the pump for feeding the moistening liquid to a moistening device of the rotary copying machine with adjusting means for the pump stroke.
Figure 2:
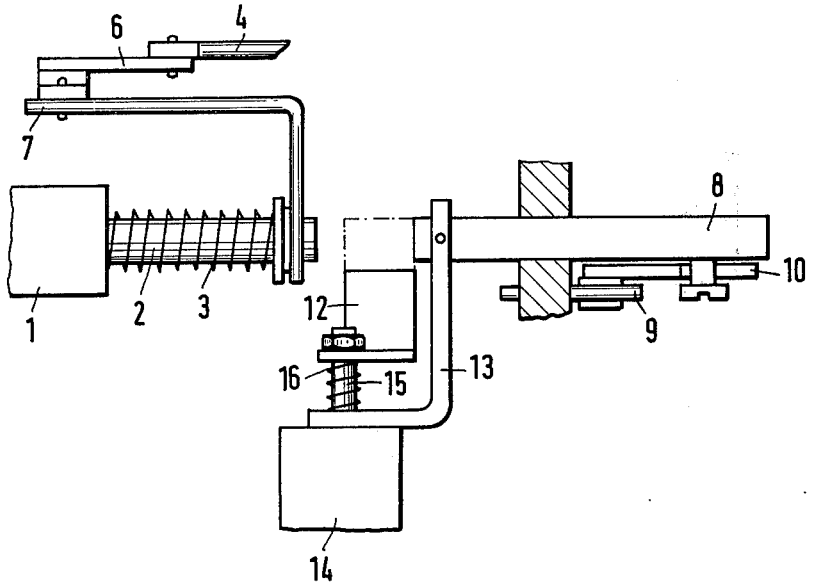
FIG. 2 illustrates the arrangement shown in FIG. 1 in top view.

To move the elongated cam 27 into the region of a follower roller 33 a greater shifting of the control rod 62 is necessary. This is accomplished by the pull magnet 54 and the lever 61 connected thereto. To energize the pull magnet 54, the switch 57 is closed. Connected in parallel to the pull magnet 54 is an electromagnet 14 which therefore will be energized together with the pull magnet 54. The armature 15 of the magnet 14 is connected, as best shown in FIG. 2, to a stop 12 moveable, when the magnet 14 is energized, to the position shown in full lines in FIG. 2, whereas when the magnet 14 is deenergized, a coil compression spring 16 wound about the armature 15 moves the stop 12 to the position shown in dash-dotted lines in FIG. 2 in which the stop is located in the path of the return movement of the piston 2 of the pump 1 to limit the stroke of the piston to approximately half of the maximum stroke, the piston would carry out under the action of the spring 3 during rotation of the cam 4. The magnet 14 is connected by a bracket 13 to an additional stop 8 located in the path of the movement of the piston 2 and steplessly adjustable in the direction of movement of the piston by means of an angle lever 10 tiltable about a fixed pin 11 and carrying on the free end thereof a roller follower contacting an adjustable cam disk 9. By adjusting the position of the cam disk 9 about the turning axis it is possible to adjust the axial position of the stop 8 and therewith the movement of the piston in the direction of the arrow B, which in turn will adjust the amount of fluid pumped by the pump during the pumping stroke in the direction A when the stop 12 is moved to the position shown in full lines in FIG. 2. Such an adjustment of the pumping stroke of the pump piston is for instance necessary to adjust the amount of fluid to the kind of paper from which the sheets 39 are formed or to adjust the amount of fluid to the temperature of the surrounding atmosphere.

Such an adjustment of the stop 8 is carried out during full page printing of the sheets. Theoretically, it would also be possible to construct the cam 9 in such a manner that the stop 8 could also be adjusted to limit the stroke of the pump piston further so as to reduce the amount of fluid to be pumped by the pump during line printing. However, to avoid any faulty operation, the aforementioned stop 12 is provided connected by the bracket 13 to the stop 8 and moveable transverse to the direction of movement of the pumping piston 2 in the manner as described before so that the stop 12 is moved out of the path of movement of the piston 2 during energizing of the magnet 14 which will occur simultaneously with energizing of the pull magnet 54 which, during energizing, moves the elongated cam 27 into the region of the roller follower 33 to thereby increase automatically the pumping stroke of the piston 2 during full page printing.

By opening the closed switches 55, 56, respectively 57 the circuit for the respective magnets 52, 53 and 54 is interrupted. The control rod 62 is thereby again moved to its starting position by the tension spring 58 and the individual control cams are moved out of the region of the roller follower 33. By opening the switch 57 the electromagnet 14 is likewise deenergized and the stop 12 is moved by the spring 16 into the path of the pumping piston 2.

It will be understood that each of the elements described above, or two or more together, may also find a useful application in other types of rotary copying machines differing from the types described above.

While the invention has been illustrated and described as embodied in a rotary copying machine in which the stroke of a piston pump for supplying liquid to the moistening device of the machine is automatically adjustable depending whether the copying machine is adjusted for line printing or full page printing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rotary copying machine comprising a rotatable printing drum carrying a printing form; a back pressure roller movable toward and away from the printing drum; means for feeding sheets to be printed between said printing drum and said back pressure roller; adjustable means for cyclically moving said back pressure roller during each revolution of said printing drum for selectively printing either a full page or a section of a full page of the printing form on the sheet; means for feeding a moistening liquid onto the sheets while they are fed between the drum and the roller and comprising a pump with a reciprocating piston; adjustable stop means; and locating means operatively connected to said adjustable means for locating said adjustable stop means in the path of said piston to limit the stroke of the latter during printing of a section of a full page and for locating said adjustable stop means out of the path of said piston during printing of a full page.

2. A rotary copying machine as defined in claim 1, wherein said stop means comprises a first stop movable transverse to the direction of movement of said piston between two end positions in one of which said first stop is located in said path of said piston and in the other of which said first stop is located out of said path of said piston and adjustable in the direction of movement of said piston between an infinite number of successive positions.

3. A rotary copying machine as defined in claim 2, further comprising a second stop adjustable in the direction of movement of said piston between an infinite number of successive positions for fine adjustment of the stroke of the piston during printing of a full page and when said first stop is moved to said one of said end positions.

4. A rotary copying machine as defined in claim 2, wherein said locating means comprises biasing means acting on said first stop to locate the latter in the path of said piston during printing of a section of a full page, and an electromagnet energized simultaneously with adjustment of said adjustable means for printing of a full page of the printing form on the respective sheet for withdrawing said first stop out of the path of said piston.

5. A rotary copying machine as defined in claim 3, wherein said first and second stops are connected to each other for movement in the direction of the movement of said piston.

6. A rotary copying machine as defined in claim 1, including spring means biasing said piston in one direction of reciprocation, cam means connected to said printing drum for rotation therewith, and transmission means between said cam means and said piston for moving said piston against the force of said spring means in the opposite direction, said stop means being arranged for limiting movement of said piston in said one direction.

7. A rotary copy machine as defined in claim 1, wherein said adjustable means comprises a plurality of cams rotatable in synchronism with said printing drum about a fixed axis and respectively axially adjustable with respect to said fixed axis, and transmission means between said cams and said back pressure roller for cyclically moving said back pressure roller toward and away from said printing drum depending on the axial adjustment of the respective cams.

* * * * *